US012140311B1

(12) United States Patent
Hobson et al.

(10) Patent No.: US 12,140,311 B1
(45) Date of Patent: Nov. 12, 2024

(54) TORCH LIGHTERS AND FLAME-COLORING INSERTS THEREFOR

(71) Applicant: Hacksmith Entertainment Ltd., Cambridge (CA)

(72) Inventors: Jamie Alexander Hobson, Cambridge (CA); Ian Douglas Hillier, Cambridge (CA); Hiu Wai McGill, Cambridge (CA); José Eduardo Reynoso Cosillo, Cambridge (CA)

(73) Assignee: Hacksmith Entertainment Ltd., Cambridge (CA)

( * ) Notice: Subject to any disclaimer, the term of this patent is extended or adjusted under 35 U.S.C. 154(b) by 0 days.

(21) Appl. No.: 18/647,156

(22) Filed: Apr. 26, 2024

Related U.S. Application Data

(60) Provisional application No. 63/462,497, filed on Apr. 27, 2023.

(51) Int. Cl.
*F23Q 2/34* (2006.01)

(52) U.S. Cl.
CPC ..... *F23Q 2/345* (2013.01)

(58) Field of Classification Search
CPC ..... F23Q 2/345
See application file for complete search history.

(56) References Cited

U.S. PATENT DOCUMENTS

| | | | | |
|---|---|---|---|---|
| 3,468,615 | A * | 9/1969 | Carey | F23Q 2/00 431/126 |
| 5,743,724 | A | 4/1998 | Mifune et al. | |
| 6,457,781 | B1 * | 10/2002 | Cutcher | B60B 1/06 301/37.373 |
| 10,376,803 | B2 | 8/2019 | Honeck et al. | |
| 2023/0390661 | A1 | 12/2023 | Pinkham | |

FOREIGN PATENT DOCUMENTS

| | | | | |
|---|---|---|---|---|
| CN | 112944391 | A * | 6/2021 | F23Q 2/16 |
| DE | 202004003548 | U1 | 7/2004 | |
| EP | 0284701 | A1 * | 10/1988 | |
| FR | 2615597 | A1 | 11/1988 | |
| FR | 2675243 | A1 * | 10/1992 | F23Q 2/163 |
| FR | 2690976 | A1 | 11/1993 | |
| JP | H0517320 | U * | 3/1993 | |
| JP | 940003655 | Y1 * | 6/1994 | |
| JP | H10238722 | A * | 9/1998 | |
| KR | 200336656 | Y1 * | 12/2003 | |

* cited by examiner

*Primary Examiner* — Jorge A Pereiro
*Assistant Examiner* — Logan P Jones

(57) ABSTRACT

A lighter includes (a) a lighter body for storing fuel; (b) a lighter head extending upwardly from the lighter body to an outlet of the head for directing flow of the fuel toward the outlet; (c) an integrated ignition system for selectively releasing and igniting the fuel to produce a flame projecting along a flame path from the outlet; and (d) a replaceable flame-coloring insert including an insert body removably mounted to the lighter head adjacent the outlet. The insert body treated with a flame colorant positioned in the flame path for coloring the flame when heated.

11 Claims, 8 Drawing Sheets

TORCH LIGHTERS AND FLAME-COLORING INSERTS THEREFOR

CROSS-REFERENCE TO RELATED APPLICATIONS

This application claims the benefit of U.S. Provisional Patent Application No. 63/462,497, filed Apr. 27, 2023, which is hereby incorporated herein by reference in its entirety.

FIELD

The teachings disclosed herein relate generally to hand-held lighters, and more specifically, to torch lighters with flame-coloring features.

INTRODUCTION

Portable, handheld lighters are versatile tools with various practical and recreational uses such as, for example, lighting candles, smoking products, stoves, and/or in hobbyist settings such as soldering and micro-electronics work, as well as culinary applications. Typical lighters often lack any unique or noteworthy features, and their flames burn in a color generally dictated by the utilized fuel. For example, in the case of common butane, the flame burns bright blue during complete combustion of the gas, and a yellow flame can be produced during incomplete combustion.

SUMMARY

The following summary is intended to introduce the reader to various aspects of the applicant's teaching, but not to define any invention.

According to some aspects, a portable, handheld torch lighter includes: (a) a lighter body including a fuel reservoir for storing fuel; (b) a lighter head extending upwardly from the lighter body to an outlet of the head for directing flow of fuel released from the fuel reservoir toward the outlet; (c) an integrated ignition system for selectively releasing the fuel from the fuel reservoir and igniting the fuel flowing through the lighter head to produce a flame projecting along a flame path from the outlet; and (d) a replaceable flame-coloring insert including an insert body removably mounted to the lighter head adjacent the outlet, the insert body treated with a flame colorant positioned in the flame path for coloring the flame when heated.

In some examples, the insert body has a base portion extending circumferentially about at least a portion of the outlet and a plurality of colorant protrusions projecting from the base portion into the flame path, each colorant protrusion treated with the colorant.

In some examples, the base portion is generally planar and oriented normal to the flame path and has an aperture extending therethrough in alignment with the flame path, and wherein each colorant protrusion projects radially inwardly from the base portion into the aperture. In some examples, the colorant protrusions are spaced circumferentially apart from each other about the flame path.

In some examples, each colorant protrusion extends radially inwardly from a root at the base portion to a tip opposite the root, the tip of each colorant protrusion positioned radially outward of an unobstructed central portion of the aperture.

In some examples, the insert body is removably mounted to the lighter head in a friction fit.

In some examples, the insert body includes a base portion extending circumferentially about at least a portion of the outlet and a plurality of retaining protrusions projecting from the base portion and spaced circumferentially apart from each other about the outlet, the retaining protrusions received in the lighter head in a friction fit to removably mount the insert body.

In some examples, the lighter head includes a head shell extending upwardly from the lighter body to an upper rim extending around the outlet, and wherein the plurality of retaining protrusions are received in the lighter head radially inward of the upper rim.

In some examples, the lighter head has an annular slot radially intermediate the upper rim and the outlet, and the plurality of retaining protrusions are received in the annular slot.

In some examples, the base portion is generally planar and orientated normal to the flame path, and the plurality of retaining protrusions project downwardly from the base portion generally parallel with the flame path for sliding into the lighter head from above.

In some examples, each retaining protrusion comprises a tab.

In some examples, each tab has a proximal tab neck bent downwardly and extending away from the base portion to a distal tab head, the tab head wider than the tab neck for increased surface area contact with the lighter head to facilitate the friction fit.

The lighter of claim 1, wherein the insert body is metal and of integral, unitary, one-piece construction.

According to some aspects, a flame-coloring insert for a torch lighter includes (a) a base portion including an aperture extending therethrough; (b) a plurality of retaining protrusions projecting from the base portion, the plurality of retaining protrusions positioned radially outward of the aperture, spaced circumferentially apart from each other about the aperture, and insertable into a head of the lighter in friction fit engagement for removably mounting the insert to the lighter with the aperture in alignment with a flame path of the lighter; and (c) a plurality of colorant protrusions projecting radially inwardly from the base portion into the aperture for positioning in the flame path when the insert is mounted, the plurality of protrusions spaced circumferentially apart from each other about the aperture, and each protrusion treated with a flame colorant for coloring a flame projecting along the flame path when the colorant is heated by the flame.

In some examples, the base portion is generally planar and oriented normal to the flame path when the insert is mounted to the lighter, and the plurality of retaining protrusions project downwardly from the base portion generally parallel with the flame path for sliding into the head of the lighter from above.

In some examples, each retaining protrusion comprises a tab.

In some examples, each tab has a proximal tab neck bent downwardly and extending away from the base portion to a distal tab head. The tab head is wider than the tab neck for increased surface area contact with the lighter head to facilitate the friction fit.

In some examples, each colorant protrusion extends radially inwardly from the base portion to a tip. The tip of each colorant protrusion positioned radially outward of an unobstructed central portion of the aperture.

In some examples, the body portion, colorant protrusions, and retaining protrusions form an insert body of integral, unitary, one-piece construction.

In some examples, the insert body is formed from sheet metal.

According to some aspects, a portable, handheld torch lighter includes: (a) a lighter body including a fuel reservoir for storing fuel; (b) a lighter head extending upwardly from the lighter body to an outlet of the head for directing flow of fuel released from the fuel reservoir toward the outlet; (c) an integrated ignition system for selectively releasing the fuel from the fuel reservoir and igniting the fuel flowing through the head to produce a flame projecting along a flame path from the outlet; and (d) a flame-coloring element adjacent the outlet, the flame-coloring element including a plurality of protrusions in the flame path and treated with a flame colorant for coloring the flame when heated.

DRAWINGS

For a better understanding of the described examples and to show more clearly how they may be carried into effect, reference will now be made, by way of example, to the accompanying drawings in which.

The drawings included herewith are for illustrating various examples and are not intended to limit the scope of what is taught in any way.

DESCRIPTION OF VARIOUS EXAMPLES

Various apparatuses, systems, or processes will be described below to provide an example of each claimed invention. No example described below limits any claimed invention and any claimed invention may cover processes, systems, or apparatuses that differ from those described below. The claimed inventions are not limited to apparatuses, systems, or processes having all of the features of any one apparatus, system, or process described below or to features common to multiple or all of the apparatuses, systems, or processes described below. It is possible that an apparatus, system, or process described below is not an example of any claimed invention. Any invention disclosed in an apparatus, system, or process described below that is not claimed in this document may be the subject matter of another protective instrument, for example, a continuing patent application, and the applicants, inventors, or owners do not intend to abandon, disclaim, or dedicate to the public any such invention by its disclosure in this document.

According to some aspects of the present teachings, lighters according to the present teachings can be configured to color a flame produced by the lighter (i.e., change the color of the flame from its usual color dictated by the fuel to a different color—for example, from a blue flame in the case of complete combustion of butane, to a red or green flame). The lighters can utilize a flame-coloring element in the lighter for coloring the flame. In some examples, the flame-coloring element can be provided as a replaceable flame-coloring insert treated with a flame colorant (e.g., a strontium or other chemical compound). The insert can vary in chemistry and design to allow control for color hue and also the length of time the flame will burn a different color than its standard color dictated by the utilized fuel. The flame-coloring elements of the present disclosure can add a unique and interesting lighter feature, as well as help with distinguishing, locating, and/or visualizing the lighter flame in media (e.g., on video, film, images, cinematic applications) and/or in bright or low-light conditions.

Figure 2:
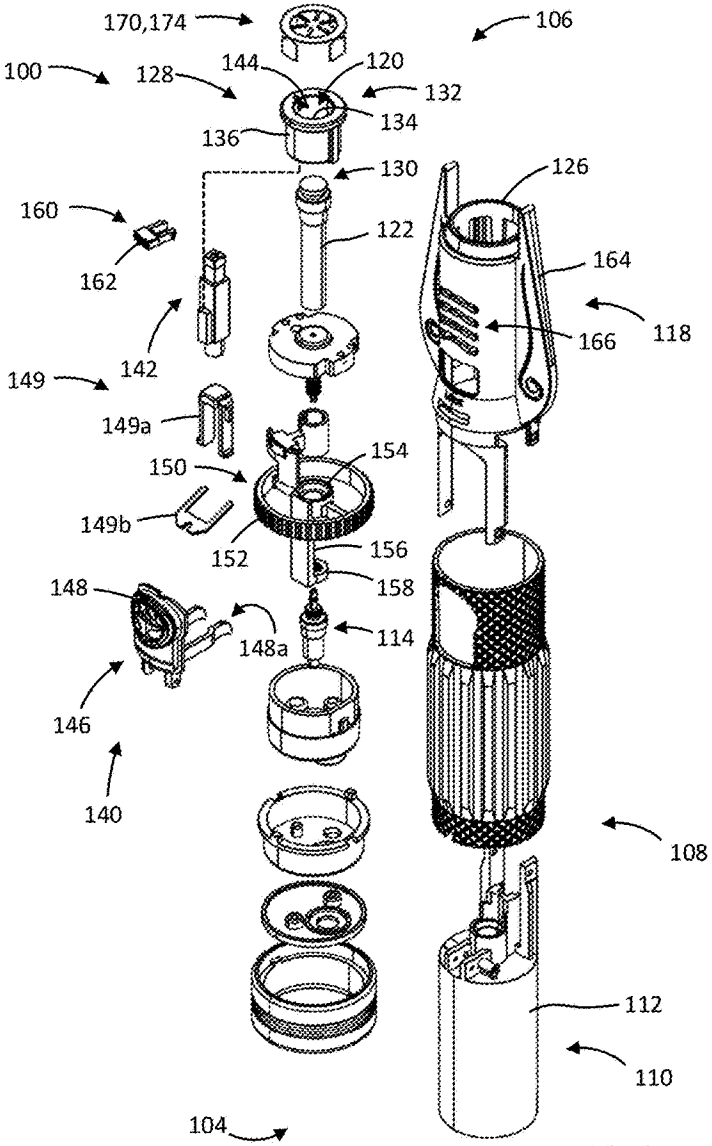
FIG. 2 is an exploded perspective view of portions the lighter of FIG. 1.
Figure 1:
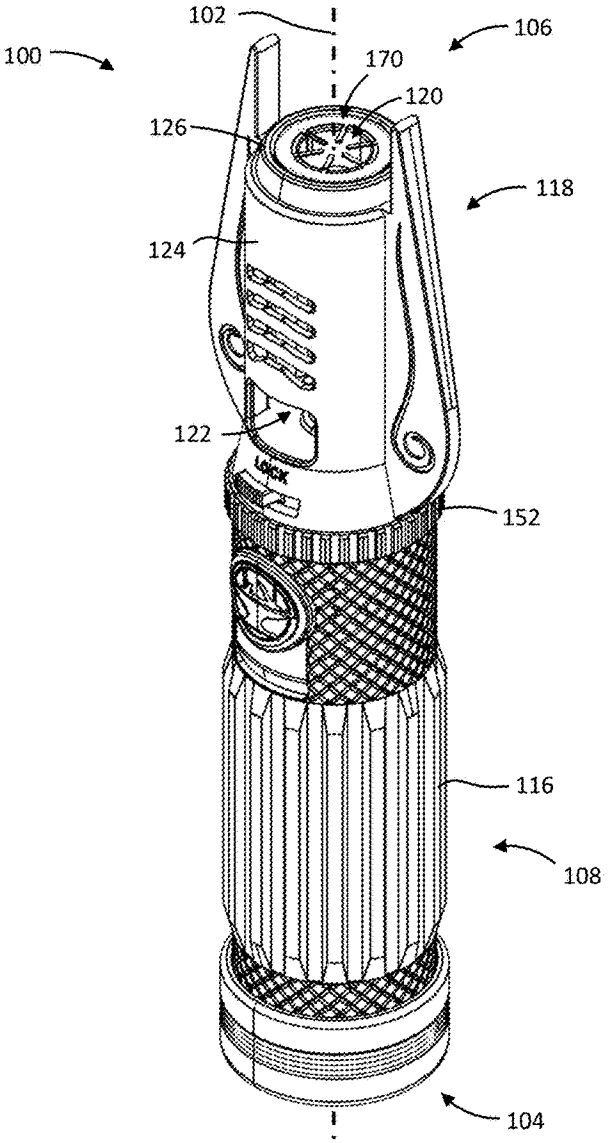
FIG. 1 is perspective view of an example lighter.

Referring to FIG. 1, an example lighter 100 is shown. In the example illustrated, the lighter 100 is in the form of a torch lighter for producing a relatively long, laminar flame projecting upwardly from the top of the lighter 100. The lighter 100 extends along a lighter axis 102 between a lower end 104 and an upper end 106 vertically opposite the lower end 104 and from which the flame projects. The lighter 100 includes a lighter body 108 at the lower end 104. Referring to FIG. 2, in the example illustrated, the lighter body 108 includes an internal fuel reservoir 110 for storing fuel. In the present example, the reservoir 110 is configured to store gaseous fuel under pressure. The fuel can comprise, for example, butane or any other suitable fuel. Other fuel types (e.g., liquid fuel) can be used in other examples. The fuel reservoir 110 can have a relatively large fuel capacity relative to more conventional handheld lighters to provide for an extended burn time.

Figure 16:
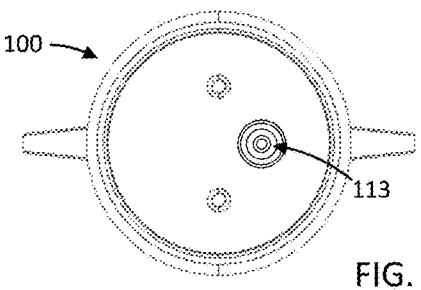

In the example illustrated, the fuel reservoir 110 comprises an internal fuel container 112 for storing the fuel. The fuel container 112 can include an injection port 113 (e.g., one-way fill port; FIG. 16) for filling/refilling the fuel container 112 with the fuel (e.g., by pressing a tip of a refilling bottle in the injection port 113; FIG. 16). In the example illustrated, the fuel injection port 113 (FIG. 16) is on an underside of the fuel container 112 and accessible through an opening in a base cap of the lighter body 108. Referring to FIG. 2, a reservoir valve mechanism 114 (e.g., comprising a gas valve) is coupled to the fuel container 112 for regulating release of fuel from the fuel reservoir 110. The reservoir valve mechanism 114 is coupled to an upper end of the fuel container 112 for releasing the fuel upwardly toward an outlet 120 at the upper end 106 of the lighter 100.

Referring to FIG. 1, in the example illustrated, the torch lighter 100 is portable, handheld, and relatively compact, with the lighter body 108 configured to serve as a handle for holding the lighter 100 in a user's hand. In the example illustrated, the lighter body 108 has a body shell 116 defining a lower portion of a housing of the lighter 100. The body shell 116 houses the fuel reservoir 110 (FIG. 2) and serves as the handle. In the example illustrated, the body shell 116 is generally cylindrical and extends along and is generally coaxial with the lighter axis 102. In the example illustrated, the body shell 116 is formed from metal, and can include an exterior surface with features (e.g., knurling, ridges, ribs, grooves, etc.) to facilitate gripping of the lighter 100, provide tactile feedback, increase surface area to help with heat dissipation, and/or provide a pleasing aesthetic.

In the example illustrated, the lighter 100 includes a lighter head 118 at the upper end 106 of the lighter 100. The lighter head 118 extends upwardly from the lighter body 108 to an outlet 120 at the top of the lighter head 118 and is configured to direct flow of fuel released from the fuel reservoir 110 toward the outlet 120. In the example illustrated, the lighter head 118 extends along and is generally coaxial with the lighter axis 102 (and lighter body 108). The lighter head 118 has an internal conduit 122 for directing flow of fuel released from the fuel reservoir 110 toward the outlet 120 of the head 118 for mixing of the fuel with air and combustion of the air-fuel mixture to produce a flame projecting from the outlet 120. In the example illustrated, the outlet 120 is generally coaxial with the lighter axis 102 and the flame projects from the outlet 120 along a flame path extending along and generally coaxial with the lighter axis 102. Such a coaxial arrangement of the lighter body 108, head 118, and flame can provide the torch lighter 100 with a pleasing aesthetic.

In the example illustrated, the lighter head 118 includes a head shell 124 defining an upper portion of the lighter housing. In the example illustrated, the head shell 124 projects upwardly from the lighter body 108 to a rim 126 extending around the outlet 120. In the example illustrated, the head shell 124 is formed from metal and is a separate component from the body shell 116. In the example illustrated, conductive heat transfer from the head shell 124 to the body shell 116 can be reduced by providing for limited direct surface area contact therebetween. The housing components (e.g., the shell portions) can be made from, for example, plastic, metal, and/or a combination thereof.

In the example illustrated, the head shell 124 houses a burner nozzle assembly 128 of the lighter 100. In the example illustrated, the burner nozzle assembly 128 includes the internal conduit 122 for directing the flow of fuel from the reservoir 110 and out through a nozzle 130 (e.g., a torch nozzle) into a burner head 132 of the burner nozzle assembly 128. The air-fuel mixture is ignitable in the burner head 132 for producing the flame. In the example illustrated, the conduit 122 comprises a metal tube through which the gaseous fuel is conducted for discharge from the nozzle 130 (e.g., through a plurality of discharge ports of the nozzle 130) at an upper end of the conduit 122. In the example illustrated, the burner head 132 comprises a burner duct 134 extending along the lighter axis 102 between the nozzle 130 and the outlet 120. In the example illustrated, a lower end of the flame path passes through the burner duct 134 and out from the outlet 120 along the lighter axis 102. In the example illustrated, the burner duct 134 comprises a ceramic isolator 136 positioned radially inward of the shell rim 126 and extending about the nozzle 130 to help isolate the flame and inhibit heat transfer and/or thermal damage to other lighter components (e.g., the head shell 124).

In the example illustrated, the torch lighter 100 further includes an integrated ignition system 140 for selectively releasing the fuel from the fuel reservoir 110 and igniting the fuel flowing through the head 118 to produce the flame projecting along the flame path from the outlet 120. In the example illustrated, the ignition system 140 includes an igniter 142 having a sparking element 144 (see also FIG. 4) adjacent the outlet 120 for generating a spark directed into the path of the fuel-air mixture flowing through the burner duct 134 to ignite the mixture and produce the flame. In the example illustrated, the sparking element 144 extends into the burner duct 134 from a sidewall of the ceramic isolator 136 for igniting the air-fuel mixture passing through the burner duct 134. The igniter 142 can comprise a piezoelectric igniter for producing an electric spark.

In the example illustrated, the ignition system 140 further includes an actuator 146 operable by the user to actuate the reservoir valve mechanism 114 for releasing the fuel, and to actuate the igniter 142 to generate the spark for igniting the fuel. In the example illustrated, the actuator 146 comprises a button 148 depressible by the user (radially inwardly toward the lighter axis 102, in the example illustrated) to both release the fuel and generate the spark in a single action. In the example illustrated, the button 148 is mounted to the lighter body 108 generally flush with the body shell 116 adjacent an upper end of the lighter body 108 (near the lighter head 118), to allow for actuation of the button 148 with a user's thumb while gripping the lighter body 108. The actuator 146 further includes an internal actuator mechanism 149 coupling the button 148 to the ignitor 142 and the reservoir valve mechanism 114. The internal actuator mechanism 149 includes an igniter presser 149*a* and a valve release 149*b* internal the body 108 and which cooperate to operate the igniter 142 to generate the spark and the valve mechanism 114 to release the fuel when the button 148 is depressed. In the example illustrated, the internal actuator mechanism 149 includes a pair of arms 148*a* fixed to and projecting radially inwardly from the button 148 to a distal end of the arms 148*a* adjacent the igniter presser 149*a*. When the button 148 is depressed, the arms 148*a* move the igniter presser 149*a* for actuating the igniter 142, and movement of the igniter presser 149*a* moves the valve release 149*b* (e.g. arranged as a lever) to lift the gas valve and release the fuel. When the button 148 is released, a return spring of the actuator mechanism 149 urges the actuator 146 back to its default "off" position, in which fuel flow ceases. In some examples, the actuator button 148 can include a logo, which can be provided for marketing purposes, aesthetics, and/or to increase tactile sensitivity for the user.

In the example illustrated, the lighter 100 further includes a flame adjustment mechanism 150 for adjusting the rate of fuel release via the reservoir valve mechanism 114 to adjust flame size/intensity. In the example illustrated, the flame adjustment mechanism 150 includes a flame adjustment wheel 152 coupled to the reservoir valve mechanism 114, and rotatable about the lighter axis 102 to adjust the reservoir valve mechanism 114 for changing the fuel flow rate. In the example illustrated, the adjustment wheel is rotatable over a 45-degree sector to adjust the fuel flow rate. In the example illustrated, the adjustment wheel 152 extends completely about the lighter axis 102 (and lighter 100) and is accessible and operable by the user from all sides of the lighter 100. In the example illustrated, the flame adjustment mechanism 150 includes an internal hub 154 radially inward of and fixed to the adjustment wheel 152. A shaft portion 156 is fixed to and extends downwardly from the hub 154 parallel with the lighter axis 102 to a lower collar 158 rotationally fixed to a valve stem of the reservoir valve mechanism 114. Rotation of the wheel 152 results in a corresponding rotation of the lower collar 158 and valve stem to adjust the fuel flow rate through the reservoir valve mechanism 114. In the example illustrated, the adjustment wheel 152 is positioned vertically intermediate the lighter body 108 and the lighter head 118, and is above and adjacent the actuator button 148 to facilitate ergonomic operation of the wheel 152 with a user's thumb and forefinger. In the example illustrated, the wheel 152 (which can also be referred to as a dial) is ring-shaped and comprises a textured (e.g., ribbed or knurled) exterior surface to facilitate gripping and rotation of the wheel 152 by the user.

In the example illustrated, the lighter 100 further includes a safety lock mechanism 160 to help prevent accidental fuel release and ignition. In the example illustrated, the safety lock mechanism 160 includes a toggle switch 162 comprising a slider on the lighter head 118 above and adjacent the adjustment wheel 152. In the example illustrated, the switch 162 is movable (e.g., slidable) between a locked position, in which the safety lock mechanism 160 blocks actuation of the actuator 146 (e.g., depression of the button 148) to prevent fuel release and ignition, and an unlocked position in which the safety lock mechanism 160 is clear of the actuator 146 to permit its actuation (e.g., depression of the button 148) for releasing and igniting the fuel.

In the example illustrated, the lighter head 118 includes one or more heat dissipating features, such as, for example, a plurality of fins 164 extending from the head shell 124 to increase surface area for heat dissipation, and a plurality of vents 166 (cut-outs/openings) formed in the head shell 124. The fins 164 can also include functional aesthetic features, such as a filigree or engravement, which can improve aesthetics of the lighter 100 and/or increase surface area to help with heat dissipation.

In the example illustrated, the lighter head 118 can include one or more safety features. The safety features can include a guard structure projecting upwardly beyond the outlet 120 (and flame source/base of the flame), which in some examples can serve to guard the user's finger from potential burns. In the example illustrated, the guard structure comprises an upper portion of the fins 164 which are spaced circumferentially apart from each other about the outlet 120 and extend upwardly past the outlet 120.

Figure 3:
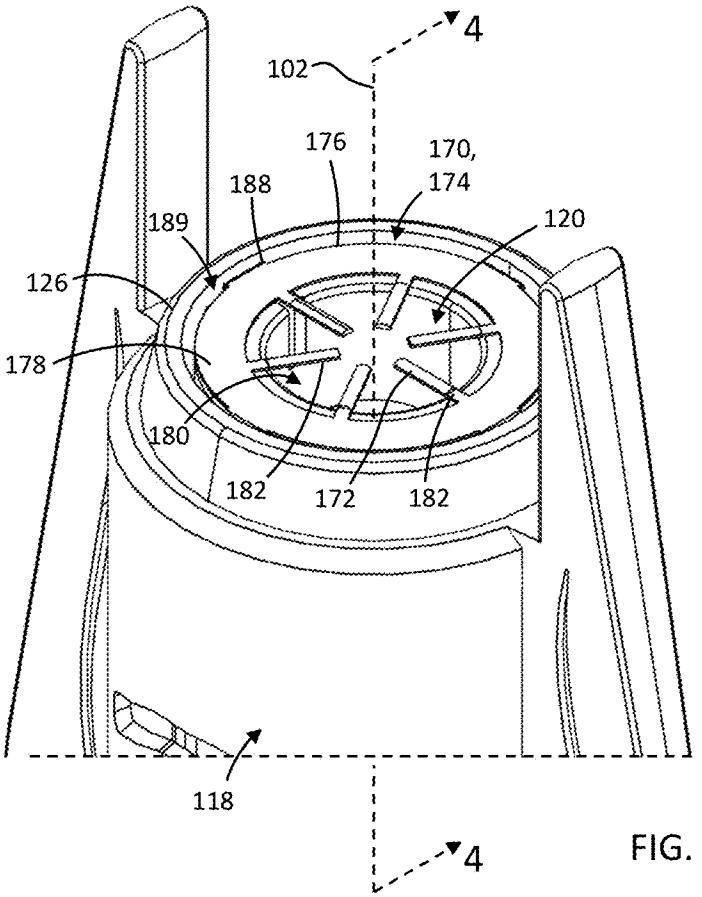
FIG. 3 is an enlarged perspective view of an upper portion of the lighter of FIG. 1.

In the example illustrated, the lighter 100 includes a flame-coloring element 170 adjacent the outlet 120. Referring to FIG. 3, in the example illustrated, the flame-coloring element 170 includes a flame colorant 172 positioned in the flame path for coloring the flame when heated by the flame. In the example illustrated, the flame-coloring element 170 is in the form of a replaceable flame-coloring insert 174. The insert 174 includes an insert body 176 removably mounted to the lighter head 118 adjacent the outlet 120 (and the flame source/base of the flame) and treated with the flame colorant 172.

The flame colorant 172 can comprise a chemical compound for coloring the flame. This can allow for the production of different flame colors under complete combustion of the fuel (e.g., of butane) without necessarily requiring a change in (or addition of additives to) the fuel itself. In some examples, the flame colorant 172 can comprise, for example, a consumable chemical compound in solid form (e.g., a solid chemical salt) capable of coloring the flame when the flame makes contact with and sufficiently heats the colorant 172. For example, when the flame is lit, the colorant 172 can react with the fire to create a colored flame along a portion or the entire length of a generally laminar flame.

Various suitable chemical compounds and/or combinations can be used to generate flames that emit light of various suitable wavelengths including in the visible or invisible spectrum and/or with colors such as, for example, red, orange, yellow, green, blue, purple, and the like. Examples of flame colorants include strontium compounds (e.g., strontium chloride $Cl_2Sr$, for producing a red flame), barium compounds (e.g., barium chloride $BaCl_2$), and lithium compounds (e.g., lithium carbonate $Li_2CO_3$ or $CLi_2O_3$). Some additional example colorants include strontium nitrate mixed with potassium chloride (for producing a purple flame), as well as boron (for producing a pale green flame), cesium (for producing a pale white flame), copper (for producing a deep green flame), potassium (for producing a whitish pink flame), and/or any other chemical compounds capable of coloring the flame and with which the insert 174 can be treated (e.g., which can be adhered to the insert body 176 and reduced to a solid form).

When the flame-coloring element 170 is in position, the colorant 172 will burn for an amount of time corresponding to the amount of colorant 172 integrated with the element 170. The color of the flame can also be varied from insert-to-insert by varying the type and amount of chemical additive included in the element 170. For example, in examples in which the colorant 172 comprises a strontium salt, increasing the amount of strontium can result in a more intense or longer-lasting color display. Similarly, combining the strontium with other chemicals can produce a wide range of different color effects, and the potential inclusion of other chemical additives can produce effects in addition to color (such as sound, sparkling, etc.).

In some examples, the flame-coloring element 170 can include an amount and surface area of colorant 172 (e.g., strontium chloride or other suitable colorant) to provide a colorant consumption rate when exposed to the flame of, for example, 0.25 g/m, 0.5 g/m, 0.75 g/m, 1.0 g/m, 1.25 g/m, 1.5 g/m, 1.75 g/m, 2.0 g/m, and the like or a range between such values. In some examples, the flame-coloring element when full of colorant 172 (i.e., prior to any depletion of the colorant) can contain between 1-3 g of consumable colorant. In some examples, the flame-coloring element when full of colorant can contain 1.25 g, 1.5 g, 1.75 g, 2.0 g, 2.25 g, 2.5 g, 2.75 g, 3.0 g, 3.25 g, 3.5 g, 3.75 g, 4.0 g, 4.25 g, 4.5 g, 4.75 g, 5.0 g, or the like of the flame colorant, or a range between such values.

In some examples, the insert body 176 can be treated with the colorant 172 by, for example, coating all or portions of the insert body 176 with the colorant. For example, the insert body 176 can be dip coated for treatment with the colorant, and/or the colorant 172 can be applied to all or portions of the insert body 176 as a paste, brushed, melted (e.g., soldered), or otherwise deposited onto the insert body 176. In some examples, the colorant compound 172 (e.g., a chemical salt) can be mixed with a binding agent to be help with adherence of the colorant 172 to the insert body 176. In some examples, treating the insert body 176 with colorant can include doping all or a portion of the insert body 176 with the colorant.

Referring to FIG. 3, in the example illustrated, the insert body 176 has a base portion 178 shaped to extend circumferentially about at least a portion of the outlet 120. In the example illustrated, the base portion 178 is generally annular (e.g., ring-shaped) and is generally coaxial with the outlet 120 (and the flame path). In the example illustrated, the base portion 178 has an aperture 180 extending therethrough. The aperture 180 is in alignment with the flame path (and generally coaxial with the flame path and the lighter axis 102 in the example illustrated). In the example illustrated, the base portion 178 is generally planar and oriented generally perpendicular to the flame path. In the example illustrated, the base portion 178 extends entirely about the outlet 120 radially outward (and generally clear of) the outlet 120, which is defined by an opening in the top of the ceramic isolator 136 (FIG. 4) in the example illustrated. In the example illustrated, the base portion 178 is positioned atop an upper surface of the ceramic isolator 136 (FIG. 4) circumscribing the outlet 120.

The insert body 176 can include at least one colorant protrusion 182 projecting from the base portion 178 into the flame path and treated with the flame colorant 172. In the example illustrated, the insert body 176 includes a plurality of colorant protrusions 182 (which can also be referred to as inner protrusions or teeth), each treated with the flame colorant 172. This can provide for increased surface area for adherence of the colorant 172 and/or exposure of colorant to the flame. In the example illustrated, the plurality of colorant protrusions 182 project radially inwardly from the base portion 178 into the flame path, and are spaced circumferentially apart from each other about the flame path (and lighter axis 102/center of the aperture 180). The insert body 176 is shown with six colorant protrusions 182 in the example illustrated. Any other number of protrusions can be provided in other examples (e.g., between 1-20 colorant protrusions).

In some examples, all the colorant protrusions 182 can be treated with the same flame colorant. In some examples, different flame colorants can be applied to different colorant protrusions 182 of the same insert 174 to provide for a multi-color flame effect. In some examples, the entire insert body 176 can be treated with the colorant, which in some cases may simplify manufacturing and provide for more usable colorant (e.g., including on the base portion 178, portions or all of which may be sufficiently exposed to the flame to heat the colorant thereon for coloring the flame).

Figure 5:
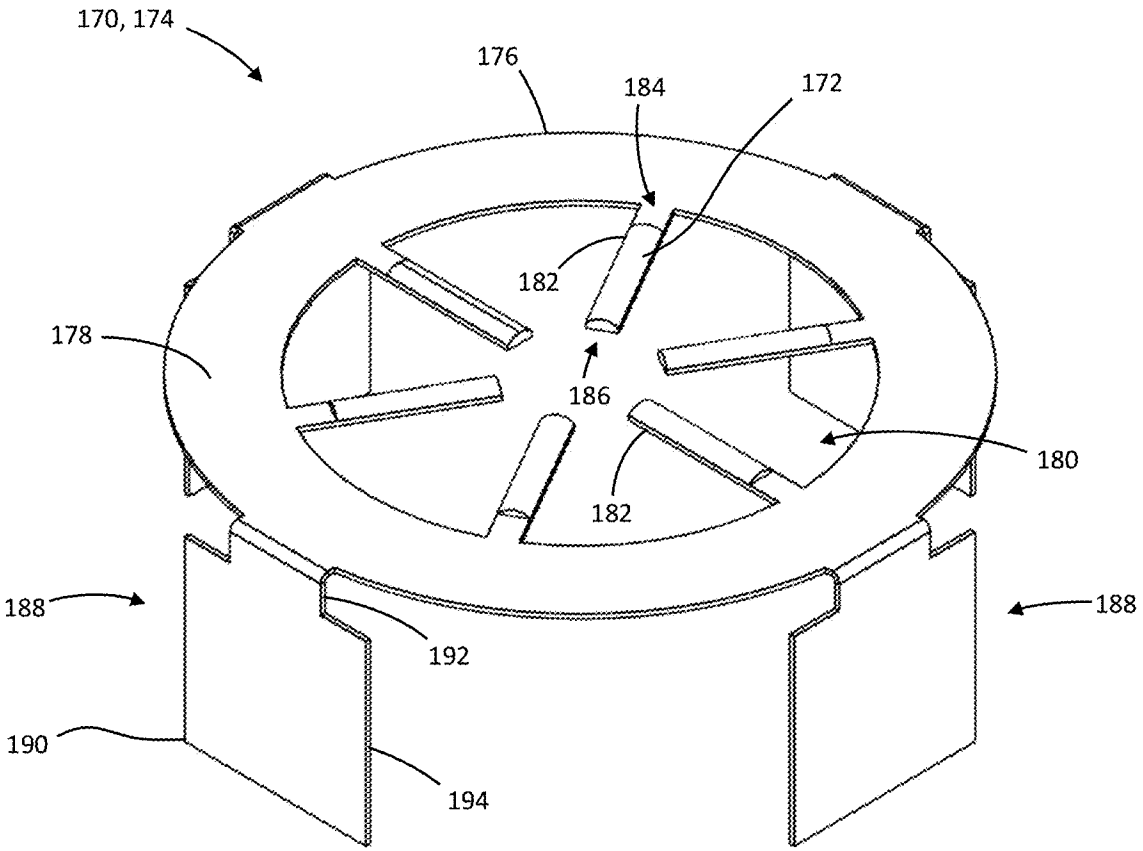
FIG. 5 is a perspective view of a flame-coloring element of the lighter of FIG. 1.
Figure 6:
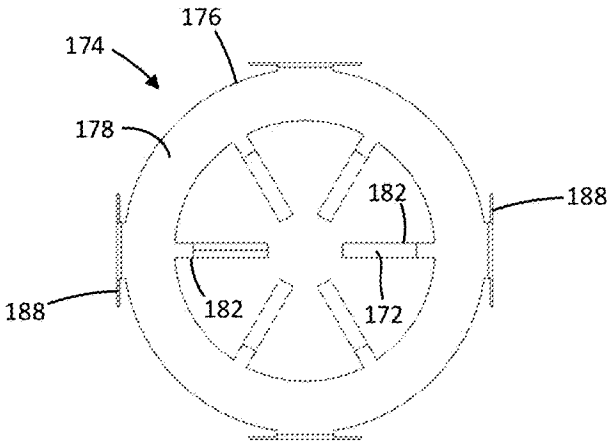
FIGS. 6-9 are top, bottom, front, and left-side views, respectively, of the flame-coloring element of FIG. 5.
Figure 7:
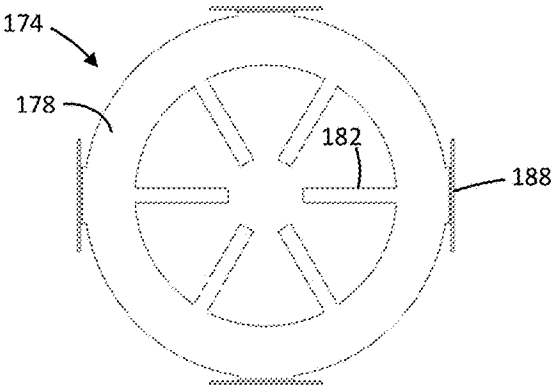
Figure 8:
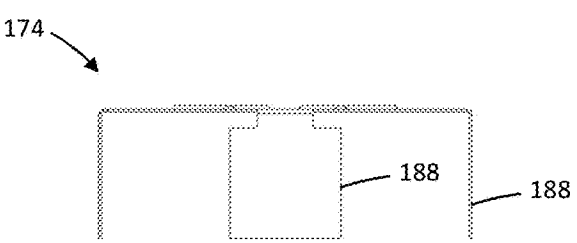
Figure 9:
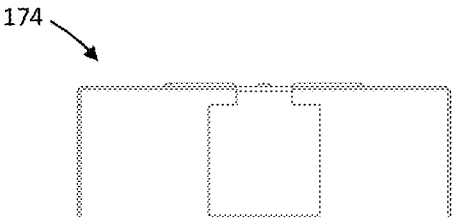

Referring to FIG. 5, in the example illustrated, each colorant protrusion 182 has an elongate protrusion body extending perpendicular to the lighter axis 102 (FIG. 1) between a root 184 at a radially inner periphery of the base portion 178 defined by the aperture 180 and a tip 186 opposite and radially inward of the root 184 toward a center of the aperture 180 (and the lighter axis 102). In the example illustrated, the tips 186 of the colorant protrusions 182 are spaced circumferentially apart from each other and positioned radially outward of an unobstructed central portion of the aperture 180 through which the flame projects. In other examples, the tips 186 of the colorant protrusions 182 may be joined together. In some examples, the protrusions 182 may be arranged differently, for example, in a mesh arrangement extending over the outlet 120 (FIG. 1).

In the example illustrated, the insert body 176 is sized for mounting to the lighter head 118 adjacent the outlet 120 (FIG. 1). In the example illustrated, the insert body 176 can include one or more retaining features to facilitate removably mounting the insert body 176 to the lighter head 118. In the example illustrated, the insert body 176 is removably mounted to the lighter head 118 in a friction fit, and the one or more retaining features comprise at least one retaining protrusion 188 projecting from the base portion 178 and received in the lighter head 118 in friction fit to removably mount the insert body 176. In the example illustrated, the insert body 176 includes a plurality of the retaining protrusions 188 (also referred to as outer protrusions or friction teeth) projecting from a radially outer periphery of the base portion 178 and spaced circumferentially and generally equally apart from each other about the center of the aperture 180 (and the flame path and lighter axis when the insert 174 is mounted).

Figure 4:
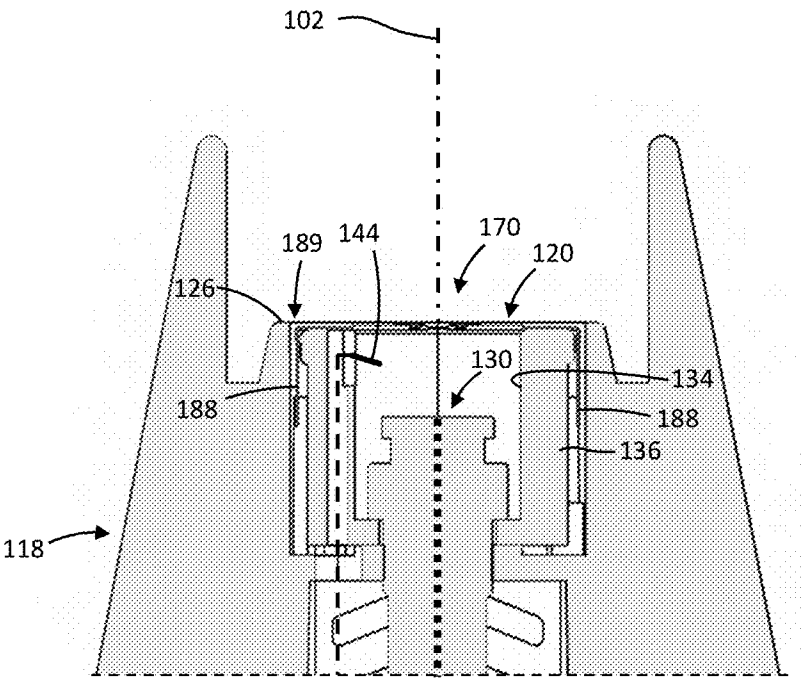
FIG. 4 is a cross-sectional view of the upper portion of FIG. 3, taken along line 4-4 in FIG. 3.

Referring to FIGS. 3 and 4, in the example illustrated, the plurality of retaining protrusions 188 are received in the lighter head 118 in friction fit to removably mount the insert body 176. In the example illustrated, the insert body 176 includes four retaining protrusions 188. The insert body 176 can include any number of the retaining protrusions (e.g., between 1-12 retaining protrusions). The retaining protrusions 188 are shaped and arranged to help achieve a relatively strong fit of the insert body 176 in the lighter head 118, while still allowing a user to pry out the insert body 176 from the lighter head 118. In some examples, the plurality of retaining protrusions 188 and lighter head 118 can be designed to index the retaining protrusions 188 in specific respective locations in the lighter head 118.

The retaining protrusions 188 can be received in respective openings (e.g., slots) in the lighter head 118, or can be received at respective spaced apart positions in a common opening or slot. The plurality of retaining protrusions 188 can be received in the lighter head 118 radially inward of the head shell rim 126, and in the example illustrated, are received radially intermediate the shell rim 126 and the outlet 120. In the example illustrated, each protrusion 188 is received in a slot 189 radially intermediate the rim 126 and the outlet 120 and sized to receive the protrusion 188 in friction fit. In the example illustrated, the slot 189 is generally annular, extends about and vertically along the lighter axis 102, and is open to the top of the lighter head 118 for receiving the plurality of retaining protrusions 188 from above. In the example illustrated, the slot 189 is bounded radially outwardly by the rim 126 and radially inwardly by the burner nozzle assembly 128 (more specifically, the ceramic isolator 136 in the example illustrated, which is spaced radially inwardly from the rim 126 by the annular slot 189).

In the example illustrated, the base portion 178 of the insert 174 is generally planar and orientated normal to the flame path when the insert 174 is mounted. The plurality of retaining protrusions 188 project downwardly from and perpendicular to the base portion 178 generally parallel with the flame path for insertion into the slot 189 in the lighter head 118 from above. Referring to FIG. 5, in the example illustrated, each retaining protrusion 188 comprises a retaining tab 190. The retaining tabs 190 are generally planar. This can for example, facilitate friction fit engagement with the lighter head 118 (FIG. 1) and/or bending of the tabs 190 during formation of the insert 174. In the example illustrated, each tab 190 has a proximal tab neck 192 bent downwardly and extending away from the base portion 178 to a distal tab head 194. The tab head 194 is wider than the tab neck 192. This can facilitate bending of the tab at the tab neck 192 during formation of the insert 174, while facilitating increased contact of the tab head 194 with the lighter head 118 (FIG. 1) to facilitate the friction fit.

The insert body 176 can be made of, for example, a non-consumable, fire-proof, and/or corrosion proof material. In the example illustrated, the insert body 176 is metal, and can be formed from, for example, aluminum (which can help with heat dissipation and allow for a user to more quickly handle the insert body 176 after being heated relative to some other metals). In some examples, the insert body 176 can be formed from a different metal, such as, for example, titanium, stainless steel, or any other metal suitable for the purposes disclosed herein, and which can be treated with the flame colorant.

Figure 10:
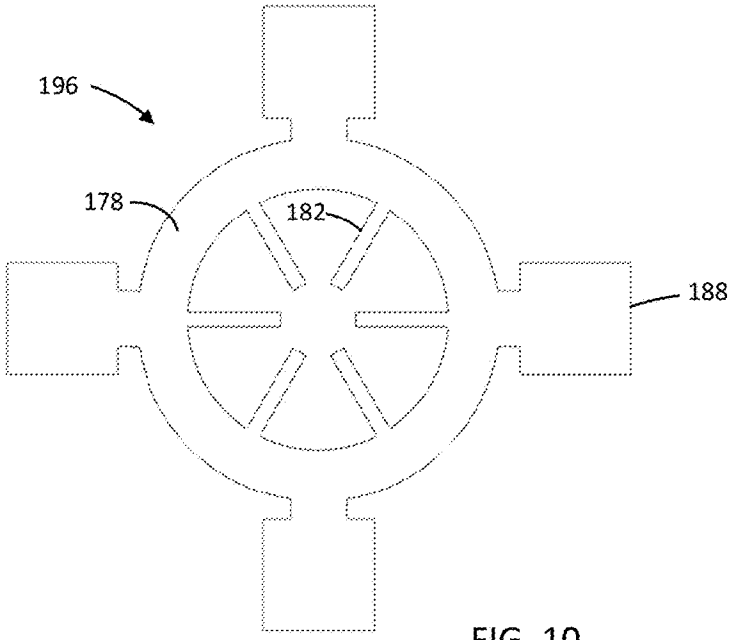
FIG. 10 is a top view of a blank for forming the flame-coloring element of FIG. 5.
Figure 11:
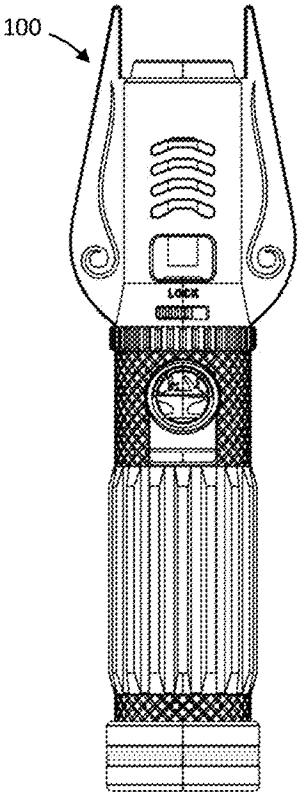
FIGS. 11-16 are front, rear, left-side, right-side, top, and bottom views, respectively, of the lighter of FIG. 1.
Figure 12:
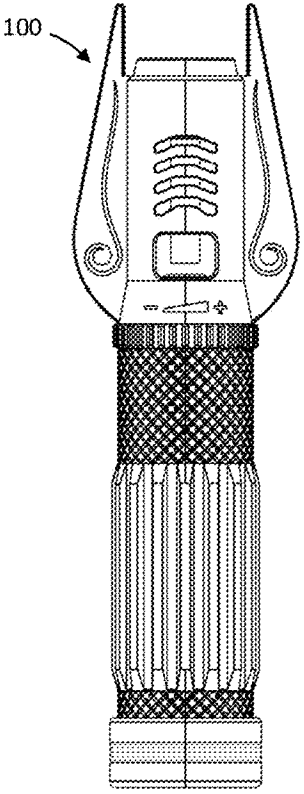
Figure 13:
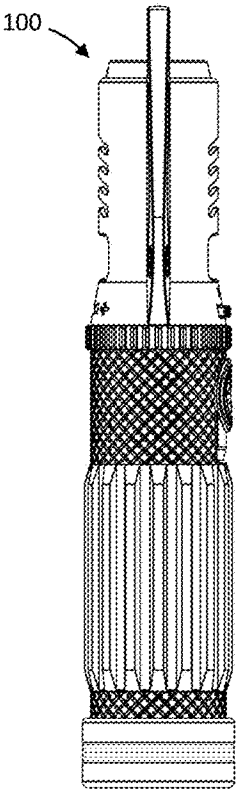
Figure 14:
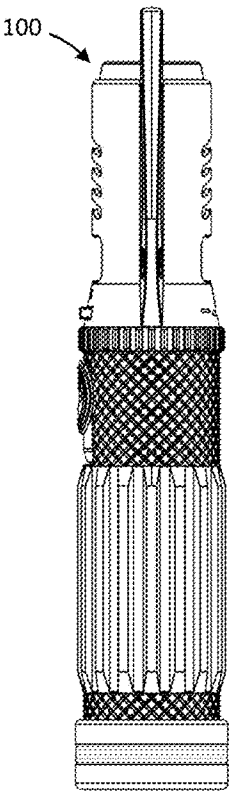
Figure 15:
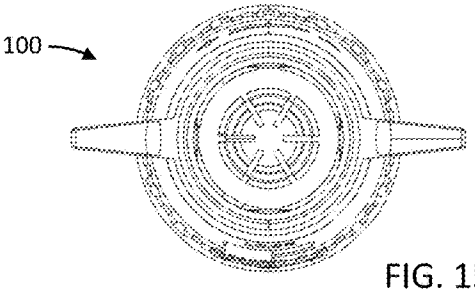

In the example illustrated, the insert body 176 is of integral, unitary, one-piece construction. In the example illustrated, the insert body 176 is fabricated from sheet metal in a sheet metal fabrication process. Referring to FIG. 10, the sheet metal fabrication process can include producing a blank 196 from sheet metal (e.g., in a cutting or stamping operation) defining the base portion 178, colorant protrusions 182, and retaining protrusions 188. The retaining protrusions 188 of the blank 196 can then be bent relative to the base portion 178 in a bending operation to form the insert body 176 (shown in FIG. 5).

Referring to FIGS. 1 and 2, in use, a user fills the fuel reservoir 110 with lighter fluid (e.g., butane), presses the actuator button 148 to release the fuel and generate a spark to ignite the fuel and produce the flame. When the flame is lit, it comes into contact with the colorant of the insert 174, producing a colorful flame (i.e., a flame with a color different from the usual flame color of the utilized fuel). The user can release the actuator button 148 to shut off the flame. Once the colorant is depleted (e.g., burnt off) or the insert 174 is removed, the lighter 100 can still be used to produce a flame with its standard color corresponding to the utilized fuel (e.g., blue for butane).

In the example illustrated, the flame-coloring insert 174 is removable and replaceable by the user. For example, once the colorant is depleted from an insert 174 and the insert 174 has sufficiently cooled, a user can remove the depleted insert 174 (e.g., with their fingers or by prying out the insert 174 upwardly from the lighter head with a tool) and install a fresh insert 174 on the lighter 100 for further coloring of the flame. In the example illustrated, no user servicing is needed and during normal operation the removal of the insert 174 can be done without tools, or with simple tools common to most households (e.g., pliers) or provided with the lighter 100 or pack of inserts 174 (such as a metal prying tool).

The lighter 100 can be provided with a single flame-coloring insert 174 preinstalled and/or separately for installation by the user. The flame-coloring inserts 174 can also be provided in a replacement pack including a plurality of the flame-coloring inserts 174 (e.g., with the same or different flame colorants for producing the same or different flame colors).

Figure 17:
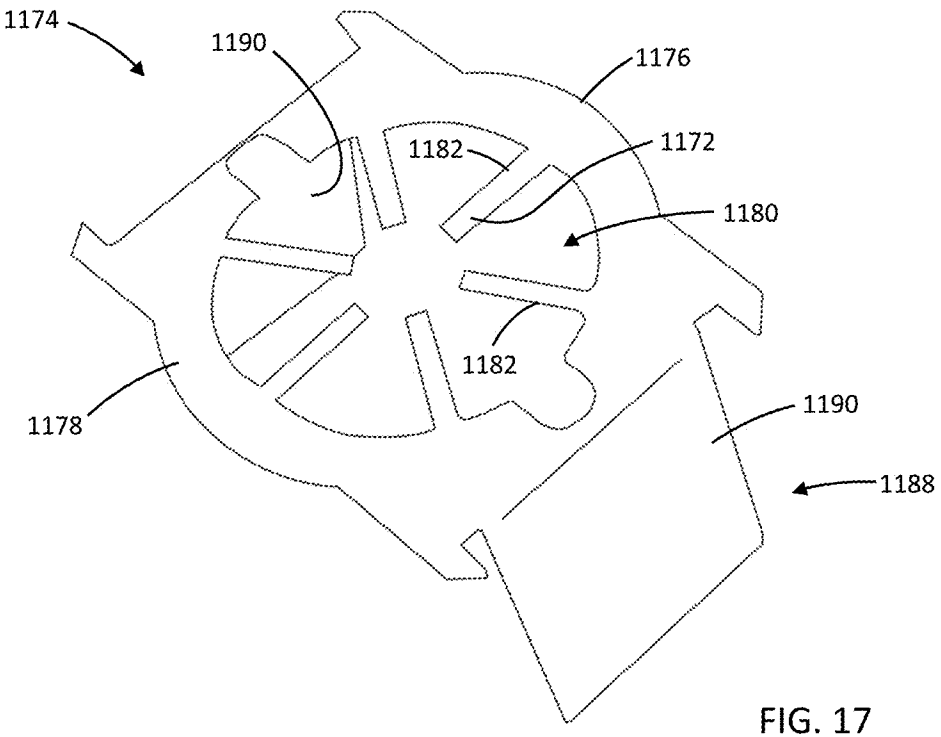
FIG. 17 is a perspective view of another example flame-coloring element for a lighter like that of FIG. 1.

Referring to FIG. 17, another example flame-coloring element in the form of an insert 1174 for use with a lighter (e.g., like the lighter 100) is shown. The flame-coloring insert 1174 has similarities to the flame-coloring insert 174, and like features are identified with like reference characters, incremented by 1000.

In the example illustrated, the insert 1174 includes an insert body 1176 treated with a flame colorant 1172. The insert body 1176 includes a base portion 1178 shaped to extend circumferentially about at least a portion of the lighter outlet. In the example illustrated, the base portion 1178 is generally annular for positioning about the lighter outlet generally coaxial with the flame path. In the example illustrated, the base portion 1178 has an aperture 1180 extending therethrough for positioning in alignment with the flame path. In the example illustrated, the base portion 1178 is generally planar and oriented generally perpendicular to the flame path when the insert 1174 is mounted to the lighter.

The insert body 1176 further includes a plurality of colorant protrusions 1182 projecting radially inwardly from the base portion 1178 into the aperture 1180 (and flame path when the insert 1174 is mounted to the lighter). Each colorant protrusion 1182 is treated with the flame colorant 1172. In the example illustrated, the entire insert body 1176 is treated with the flame colorant 1172. The insert body 1176 is shown to include six colorant protrusions 1182 spaced circumferentially and generally equally apart from each other about a center of the aperture 1180 (and the flame path when the insert 1174 is mounted to the lighter).

In the example illustrated, the insert 1174 is mountable to the lighter in friction fit. The insert body 1176 includes a plurality of retaining protrusions 1188 projecting from a radially outer periphery of the base portion 1178 for insertion into the lighter in the friction fit. In the example illustrated, the protrusions 1188 are spaced circumferentially and generally equally apart from each other about the center of the aperture 1180 (and the flame path/lighter axis when the insert 1174 is mounted). In the example illustrated, the insert body 1176 is shown to include two retaining protrusions 1188 on opposite sides of the insert body 1176.

In the example illustrated, the base portion 1178 of the insert 1174 is generally planar and orientated normal to the flame path when the insert 1174 is mounted. The plurality of retaining protrusions 1188 project downwardly from and perpendicular to the base portion 1178 for positioning generally parallel with the flame path. In the example illustrated, each retaining protrusion 1188 comprises a retaining tab 1190. Each retaining tab 1190 has a generally constant width in the example illustrated. In the example illustrated, the insert body 1176 is produced in a sheet metal fabrication process (e.g., by cutting and blank and bending the tabs 1190 relative to the base portion 1178 to form the insert body 1176).

Figure 18:
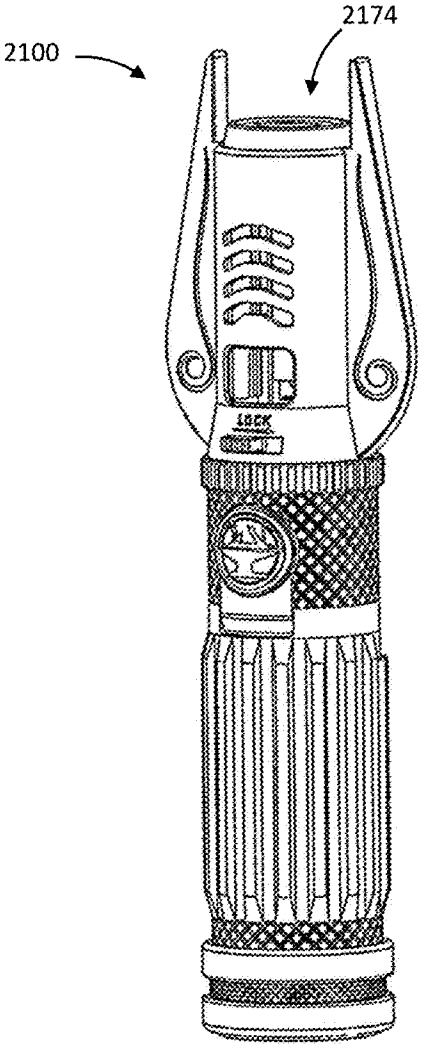
FIG. 18 is a perspective view of another example lighter.

Referring to FIG. 18, another example lighter 2100 is shown. The lighter 2100 has similarities to the lighter 100, and like features are identified with like reference characters, incremented by 2000.

Figure 19:
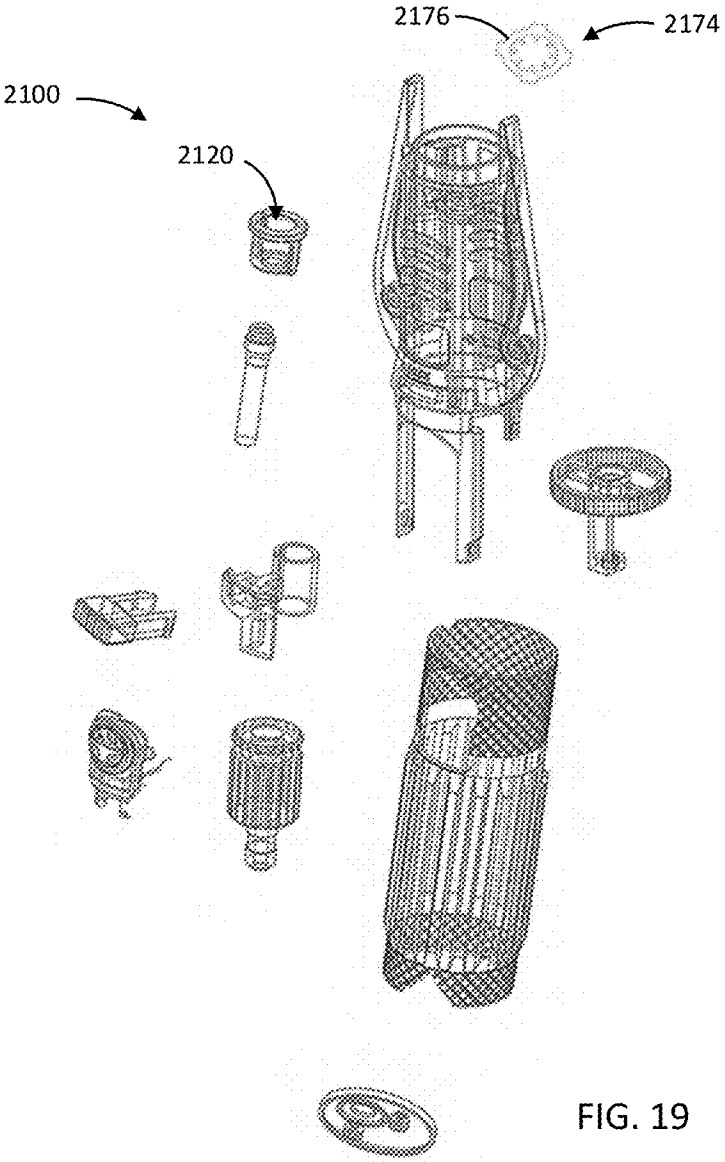
FIG. 19 is an exploded perspective view of portions of the lighter of FIG. 18.
Figure 20:
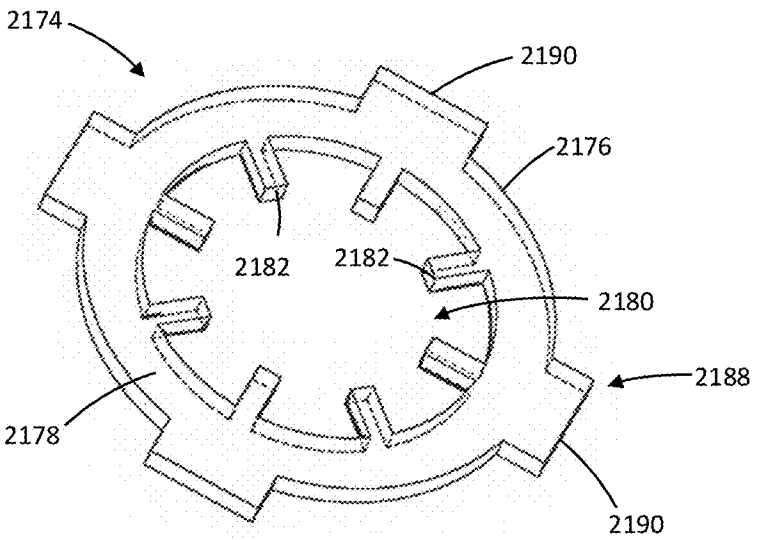
FIG. 20 is a perspective view of a flame-coloring element of the lighter of FIG. 18.

Referring to FIG. 19, in the example illustrated, the lighter 2100 includes a flame-coloring element in the form of insert 2174 having an insert body 2176 treated with a flame colorant. Referring to FIG. 20, the insert body 2176 includes a base portion 2178 shaped to extend circumferentially about at least a portion of the lighter outlet 2120 (FIG. 19). In the example illustrated, the base portion 2178 is generally annular for positioning about the lighter outlet 2120 and the flame path. In the example illustrated, the base portion 2178 has an aperture 2180 extending therethrough for positioning in alignment with the flame path. In the example illustrated, the base portion 2178 is generally planar and oriented generally perpendicular to the flame path when the insert 2174 is mounted.

In the example illustrated, the insert body 2176 includes a plurality of colorant protrusions 2182 projecting radially inwardly from the base portion 2178 into the aperture 2180 (and flame path when the insert 2174 is mounted). Each colorant protrusion 2182 is treated with a flame colorant. The insert body 2176 is shown to include eight colorant protrusions 2182 spaced circumferentially and generally equally apart from each other about a center of the aperture 2180 (and the flame path when the insert 2174 is mounted to the lighter).

In the example illustrated, the insert 2174 is mountable to the lighter in friction fit, and the insert body 2176 includes a plurality of retaining protrusions 2188 projecting from a radially outer periphery of the base portion 2178 for insertion into the lighter in friction fit to retain the insert 2174. In the example illustrated, the protrusions 2188 are spaced circumferentially and generally equally apart from each other about the center of the aperture 2180 (and the flame path/lighter axis when the insert 2174 is mounted). In the example illustrated, the insert body 2176 is shown to include four retaining protrusions 2188. Each protrusion 2188 comprises a tab 2190. In the example illustrated, the tabs 2190 extend generally parallel to (and are generally planar with) the base portion 2178.

In some examples, the lighter can be configured for installing multiple flame-coloring elements in the lighter at once, and/or to permit cycling through the multiple installed flame-coloring elements. For example, the lighter can be configured to include an adjustable retainer for holding a plurality of the flame-coloring elements, whereby the user can move the retainer relative to the flame path to select which flame-coloring element is positioned in the flame path. In some examples, each of the plurality of flame-coloring elements can include the same colorant, and can be cycled through to extend the coloring time of the flame. In other examples, each flame-coloring element can include a different colorant to produce a different flame color depending on which of the flame-coloring elements is in alignment with the flame path. In some examples, the adjustable retainer can include a rotatable platform with different flame-coloring elements positioned in respective slots (or portions) thereon and which can be rotated through by use of a dial mechanism (e.g., wheel or knob) to position one of the flame-coloring inserts into the flame path (while the remaining flame-coloring elements remain clear of the flame path).

Figure 21:
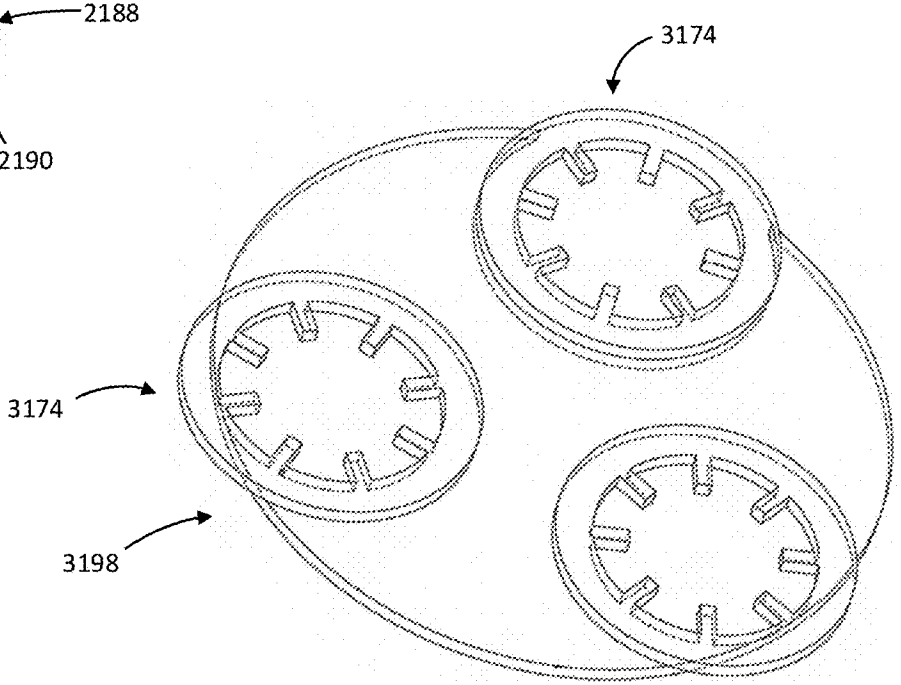
FIG. 21 is a perspective view of an example adjustable retainer holding a plurality of example flame-coloring elements.

Referring to FIG. 21, an example adjustable retainer 3198 includes a main body comprising a disc configured to retain a plurality of flame-coloring inserts 3174 spaced circumferentially apart from each other about the disc, each of which can be moved into and out of alignment with the flame path through rotation of the disc. In some examples, the adjustable retainer can be configured to retain any number of flame-coloring inserts (e.g., 2, 3, 4, 5, 6, 7, 8, 9, 10, 11, 12 or any other number). The flame-coloring inserts 3174 in the present example can be placed interchangeably or locked into the disc to be changed all at once.

The invention claimed is:

1. A portable, handheld torch lighter, comprising:

a) a lighter body including a fuel reservoir for storing fuel;

b) a lighter head extending upwardly from the lighter body to an outlet of the head for directing flow of fuel released from the fuel reservoir toward the outlet;

c) an integrated ignition system for selectively releasing the fuel from the fuel reservoir and igniting the fuel flowing through the head to produce a flame projecting along a flame path from the outlet; and d) a replaceable flame-coloring insert including an insert body removably mounted to the lighter head adjacent the outlet, the insert body treated with a flame colorant positioned in the flame path for coloring the flame when heated;

wherein the insert body includes a base portion extending circumferentially about at least a portion of the outlet and a plurality of retaining protrusions projecting from the base portion and spaced circumferentially apart from each other about the outlet, the retaining protrusions received in the lighter head in a friction fit to removably mount the insert body;

wherein the lighter head includes a head shell extending upwardly from the lighter body to an upper rim extending about the outlet, and wherein the plurality of retaining protrusions are received in the lighter head radially inward of the upper rim;

wherein the lighter head has an annular slot radially intermediate the upper rim and the outlet, and the plurality of retaining protrusions are received in the annular slot;

wherein the base portion is generally planar and oriented normal to the flame path, and the plurality of retaining protrusions project downwardly from the base portion generally parallel with the flame path for sliding into the lighter head from above;

wherein each retaining protrusion comprises a tab; and wherein each tab has a proximal tab neck bent downwardly and extending away from the base portion to a distal tab head, the tab head wider than the tab neck for increased surface area contact with the lighter body to facilitate the friction fit.

2. The lighter of claim 1, wherein the insert body has a base portion extending circumferentially about at least a portion of the outlet and a plurality of colorant protrusions projecting from the base portion into the flame path, each colorant protrusion treated with the colorant.

3. The lighter of claim 2, wherein the base portion is generally planar and oriented normal to the flame path, and has an aperture extending therethrough in alignment with the flame path, and wherein each colorant protrusion projects radially inwardly from the base portion into the aperture.

4. The lighter of claim 3, wherein each colorant protrusion extends radially inwardly from a root at the base portion to a tip opposite the root, the tip of each colorant protrusion positioned radially outward of an unobstructed central portion of the aperture.

5. The lighter of claim 1, wherein the insert body is removably mounted to the lighter head in a friction fit.

6. The lighter of claim 1, wherein the insert body is metal and of integral, unitary, one-piece construction.

7. A flame-coloring insert for a torch lighter, comprising:

a) a base portion including an aperture extending therethrough;

b) a plurality of retaining protrusions projecting from the base portion, the plurality of retaining protrusions positioned radially outward of the aperture, spaced circumferentially apart from each other about the aperture, and insertable into a head of the lighter in friction fit engagement for removably mounting the insert to the lighter with the aperture in alignment with a flame path of the lighter; and c) a plurality of colorant protrusions projecting radially inwardly from the base portion into the aperture for positioning in the flame path when the insert is mounted, the plurality of protrusions spaced circumferentially apart from each other about the aperture, and each protrusion treated with a flame colorant for coloring a flame projecting along the flame path when the colorant is heated by the flame;

wherein each retaining protrusion comprises a tab; and wherein each tab has a proximal tab neck bent downwardly and extending away from the base portion to a distal tab head, the tab head wider than the tab neck for increased surface area contact with the lighter head to facilitate the friction fit.

8. The insert of claim 7, wherein the base portion is generally planar and oriented normal to the flame path when the insert is mounted to the lighter, and the plurality of retaining protrusions project downwardly from the base portion generally parallel with the flame path for sliding into the head of the lighter from above.

9. The insert of claim 7, wherein each colorant protrusion extends radially inwardly from the base portion to a tip, the tip of each colorant protrusion positioned radially outward of an unobstructed central portion of the aperture.

10. The insert of claim 7, wherein the body portion, colorant protrusions, and retaining protrusions form an insert body of integral, unitary, one-piece construction.

11. The insert of claim 10, wherein the insert body is metal.

* * * * *